US010546567B2

(12) United States Patent
Kuno

(10) Patent No.: US 10,546,567 B2
(45) Date of Patent: Jan. 28, 2020

(54) HAMMER UNIT AND KEYBOARD INSTRUMENT

(71) Applicant: CASIO COMPUTER CO., LTD., Shibuya-ku, Tokyo (JP)

(72) Inventor: Toshiya Kuno, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/032,851

(22) Filed: Jul. 11, 2018

(65) Prior Publication Data

US 2019/0019483 A1 Jan. 17, 2019

(30) Foreign Application Priority Data

Jul. 13, 2017 (JP) ..... 2017-136751

(51) Int. Cl.
*G10H 1/34* (2006.01)

(52) U.S. Cl.
CPC ..... *G10H 1/346* (2013.01); *G10H 2220/221* (2013.01)

(58) Field of Classification Search
CPC ..... G10H 1/346; G10H 2220/221
USPC ..... 84/423 R
See application file for complete search history.

(56) References Cited

U.S. PATENT DOCUMENTS 2,958,249 A * 11/1960 Machalek ..... G10H 1/0535 84/744
3,426,636 A * 2/1969 Starck ..... G10C 3/02 84/176
4,254,684 A * 3/1981 Helpinstill ..... G10C 3/02 84/176
7,923,619 B2 * 4/2011 Suzuki ..... G10H 1/32 84/423 R
8,134,060 B2 * 3/2012 Taniguchi ..... G10H 1/346 84/423 R
9,583,086 B2 * 2/2017 Takata ..... G10H 1/34
2007/0017342 A1 * 1/2007 Nishida ..... G10C 3/12 84/423 R
2013/0152769 A1 * 6/2013 Suzuki ..... G10H 1/34 84/719
2014/0000437 A1 * 1/2014 Osuga ..... G10H 1/34 84/423 R
2018/0268787 A1 * 9/2018 Taniguchi ..... G10C 3/18
2018/0277081 A1 * 9/2018 Taniguchi ..... G10H 1/346
2019/0019483 A1 * 1/2019 Kuno ..... G10H 1/346
(Continued)

FOREIGN PATENT DOCUMENTS

JP 05073686 U 10/1993
JP 5864188 B2 2/2016
JP 2016191832 A 11/2016

*Primary Examiner* — David S Warren
*Assistant Examiner* — Christina M Schreiber
(74) *Attorney, Agent, or Firm* — Holtz, Holtz & Volek PC

(57) ABSTRACT

A hammer unit of an electronic keyboard instrument to enhance working efficiency for assembling hammer members is provided. The hammer unit comprises a plurality of hammer members which apply loads to a plurality of keys, and a holding member which holds the plurality of hammer members. The holding member is configured to have one of a first holding state in which the plurality of hammer members are temporally locked at a first position and a second holding state in which the plurality of hammer members are released from the temporally locking at the first position.

10 Claims, 8 Drawing Sheets

(56) References Cited

U.S. PATENT DOCUMENTS

2019/0019484 A1* 1/2019 Taniguchi ..... G10C 3/12
2019/0043462 A1* 2/2019 Kuno ..... G10H 1/346

* cited by examiner

HAMMER UNIT AND KEYBOARD INSTRUMENT

CROSS-REFERENCE TO RELATED APPLICATIONS

This application claims the benefit of Japanese Patent Application No. 2017-136751, filed Jul. 13, 2017, which is incorporated by reference herein in its entirety.

BACKGROUND OF THE INVENTION

Field of the Invention

The present invention relates to a hammer unit and a keyboard instrument.

Background of the Art

Conventionally, electronic keyboard instruments provided with hammer members, each of which swings responsive to a keying operation so as to bring senses of key touching close to actual acoustic keyboard instruments, are known. In such keyboard instruments, a number of hammer members corresponding to all of the keys are employed, and therefore if hammer members are assembled separately one by one, a problem that working efficiency for assembling gets worse has been raised.

Therefore, in order to improve such working efficiency for assembling, the following way to assemble the hammer members is proposed: a plurality of hammer members are divided into some blocks, and for each block, the hammer members are preassembled, and thereafter the preassembled blocks are attached to a chassis, respectively. For example, Patent Document 1 set forth below discloses a configuration that a plurality of hammer members are swingably held with a holding member (or hammer support), and the holding members being in such a state are attached to a chassis of a keyboard instrument.

Patent Document 1: Japanese Patent No. 5864188

In Patent Document 1, however, as the holding member merely holds the hammer members swingably, in attaching such a holding member to the chassis, the hammer members freely and disorderly swing, thereby resulting in making assembling difficult.

The present invention has been made in view of the above circumstances, and the present invention has one or more advantages that a hammer unit allows working efficiency in assembling hammer members to be enhanced and a keyboard instrument comprising the unit are provided.

BRIEF SUMMARY

In order to achieve the above object, a keyboard instrument according to the present invention comprises: a plurality of keys; a hammer unit including a plurality of hammer members which apply loads to the plurality of keys, and a holding member which swingably holds each of the plurality of hammer members; and a housing having at least one of restriction members which prevents at least one of the plurality of hammer members from swinging outside a restricted range, the restricted range of the at least one of the plurality of hammer members is narrower than a swing free range of the at least one of the plurality of hammer members being not provided therein. In a state in which the hammer unit is not provided in the housing, the holding member temporally locks the at least one of the plurality of hammer members at a first position located outside the restricted range. Further, in a state in which the hammer unit is provided in the housing, such that the temporally locking of the at least one of the plurality of hammer members is released by pressing the at least one of the plurality of hammer members to the at least one of restriction members, a range of motion of the at least one of the plurality of hammer members enlarges to the restricted range.

The present invention will be more understood with reference to the following detailed descriptions with the accompanying drawings.

BRIEF DESCRIPTION OF THE D WINGS

DETAILED DESCRIPTION OF THE PREFERRED EMBODIMENTS

First Embodiment

A hammer unit and a keyboard device comprising the unit according to a first embodiment of the present invention will be described below with reference to the accompanying drawings. It should be understood that in the embodiments described below, technically-preferable various limitations are added for practicing the present invention, but the scope of the present invention is not limited to the following embodiments and examples as illustrated.

Figure 1:
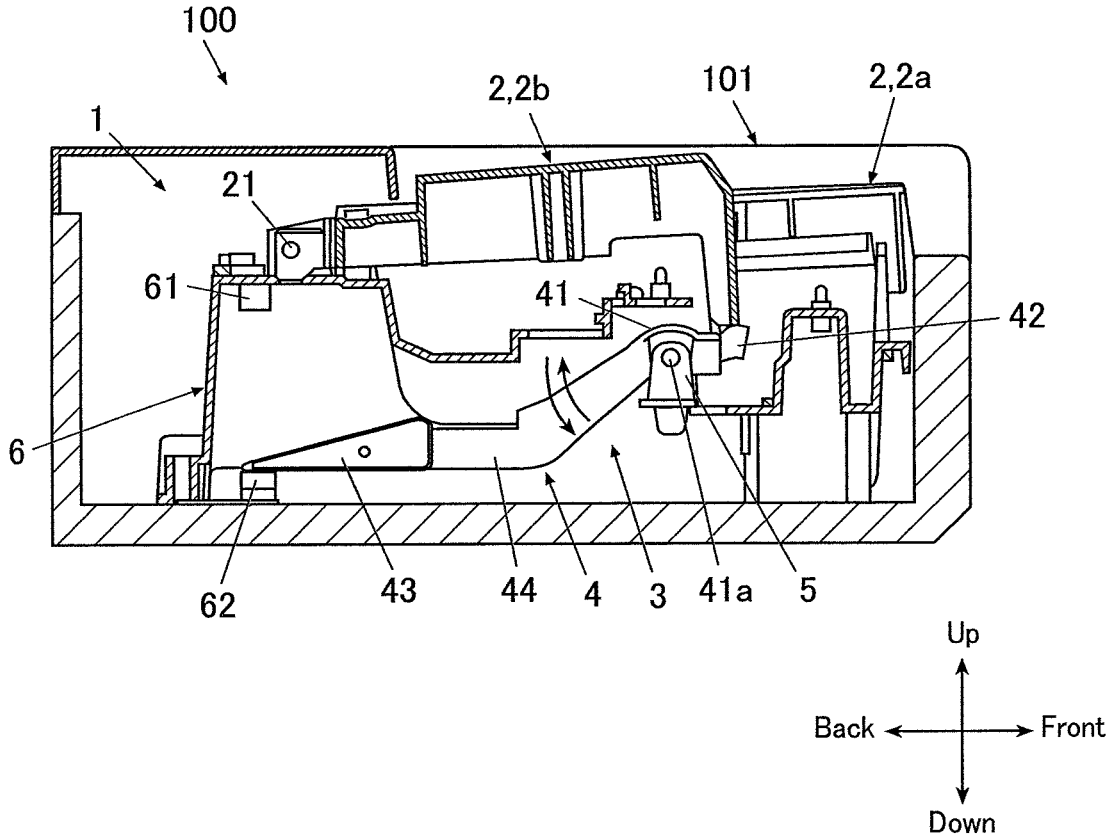
FIG. 1 is a sectional side view of an electronic keyboard instrument according to a first embodiment.
Figure 2A:
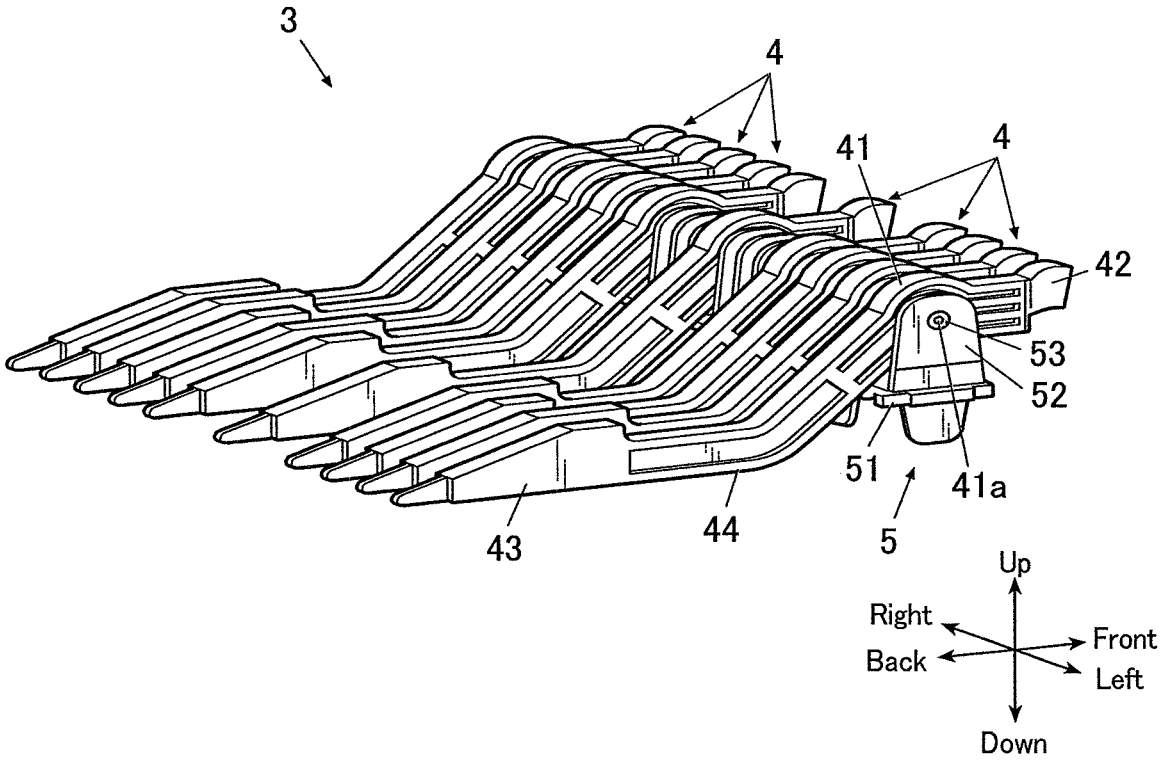
FIG. 2A is a perspective view of a hammer unit according to a first embodiment in which all of hammer members are in an initial state.
Figure 2B:
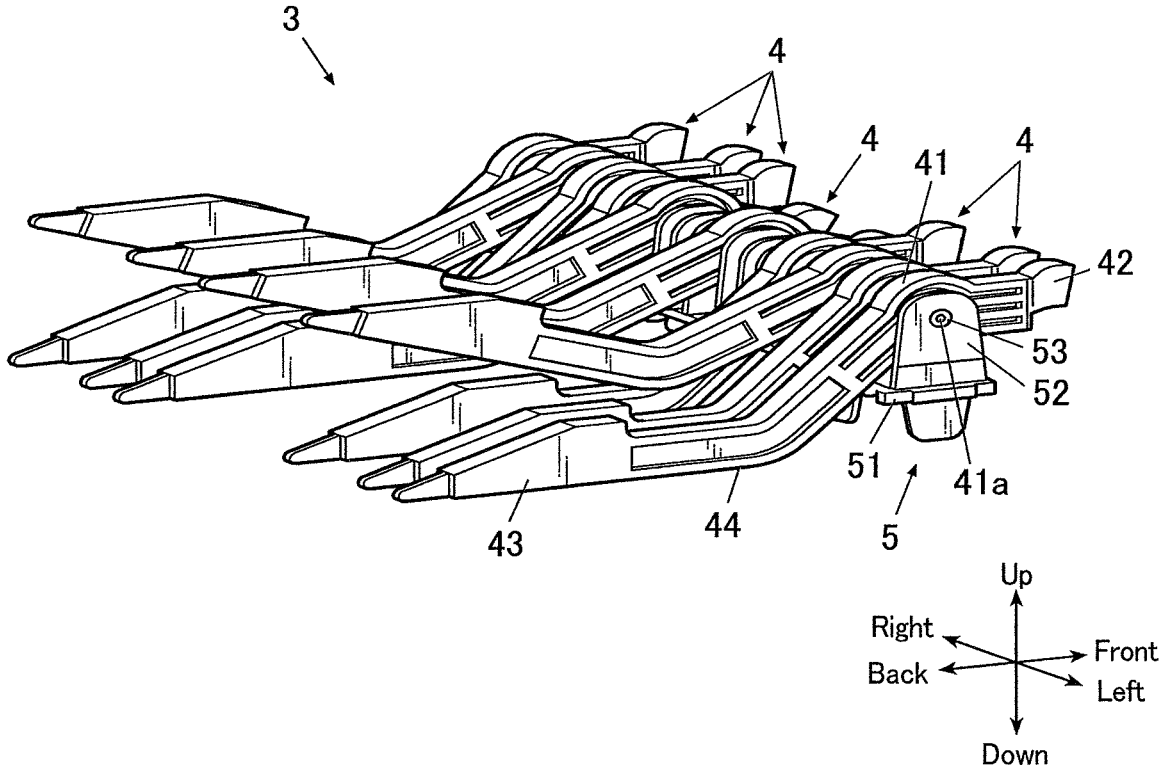
FIG. 2B is a perspective view of a hammer unit according to a first embodiment in which some of hammer members are in a swinging state.
Figure 3:
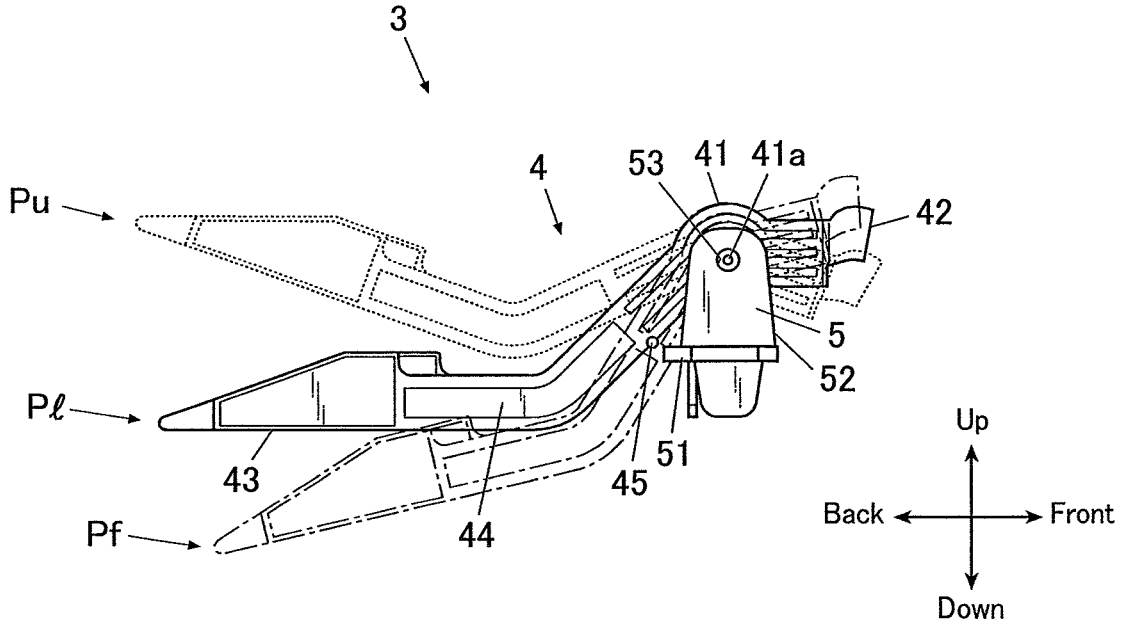
FIG. 3 is a sectional side view of a hammer unit according to a first embodiment.

FIG. 1 is a sectional side view of an electronic keyboard instrument 100 comprising a hammer unit 3 of the present embodiment. FIG. 2A is a perspective view of the hammer unit 3 in which all of hammer members are in an initial state, and FIG. 2B is a perspective view of the hammer unit 3 in which some of hammer members are in a swinging state. Further, FIG. 3 is a sectional side view of the hammer unit 3.

As shown in FIG. 1, the electronic keyboard instrument 100 of the present embodiment comprises an instrument housing 101, and a keyboard device 1 accommodated in the instrument housing 101.

The keyboard device 1 comprises a plurality of keys 2 arranged in parallel and in a horizontal direction of the electronic keyboard instrument 100 (i.e., a perpendicular direction relative to the paper's surface). The plurality of keys 2 include white keys 2*a* and block keys 2*b*, each of which is arranged to extend in a front-back direction of the electronic keyboard instrument 100. Each key 2 is rotatably configured about a rotate axis 21 of a back end thereof.

Further, the keyboard device 1 comprises a plurality of hammer units 3 arranged in the horizontal direction.

As shown in FIGS. 2A and 2B, each hammer unit 3, which is provided so as to correspond to each of the plurality of keys 2, comprises a plurality of hammer members 4 which each apply an action load to the plurality of keys 2, and a hammer holding member 5 which holds the plurality of hammer members 4.

Each hammer unit 3 is configured to hold some (e.g., 8-10) of hammer members 4 separately on a block basis. Thus, the plurality of hammer units 3 are arranged in parallel, and thereby the plurality of hammer members 4 are arranged to correspond to all (e.g., 88) of the plurality of keys 2.

Each hammer member 4 is formed in an elongated shape in the front-back direction, and comprises an axis supporting piece 41, a key linking piece 42, a weight piece 43, and a hammer arm 44.

The axis supporting piece 41, which is held by the hammer holding member 5, is provided at a front end, but slightly back therefrom, of the hammer arm 44. A rotate axis 41*a* is provided at both sides of the axis supporting piece 41. The rotate axis 41*a* is rotatably fitted into pivoting holes 53 of the hammer holding member 5 as described later, and thereby the hammer member 4 is configured to rotatably move in an up-down direction (i.e., within a plane perpendicular to the horizontal direction) about the rotate axis 41*a*.

The key linking piece 42 is provided at a tip (front end) of a portion which projects forward from the axis supporting member 41. The key linking piece 42 is linked to a front end side of the key 2 corresponding to the hammer member 4, and configured to be depressed downward in association with a keying operation against the key 2.

The weight piece 43 is provided at a back end of the hammer member 4 and has a predetermined weight.

The hammer arm 44 is an arm to link the axis supporting piece 41 and the weight piece 43. In an initial state in which the key 2 is not operated, the hammer arm 44 is formed in a shape by sloping downward and backward, and thereafter bending and extending straight backwardly.

By this configuration, when a keying operation to the corresponding key 2 is performed, the hammer member 4 allows the key linking piece 42 linked to the key 2 to be depressed and to rotate about the rotate axis 41*a* of the axis supporting piece 41 in a direction in which the weight piece 43 lifts. Further, when the key 2 is released after the keying operation, the hammer member 4 rotates in a direction in which the weight piece 43 lowers by the own weight of the weight piece 43, thereby returning to the initial state in which the key 2 is not operated.

On the other hand, the hammer holding member 5 comprises a plurality of fitting portions 52 provided to correspond to the plurality of the hammer members, respectively, on a substantially plate-like base plate 51.

Each fitting portion 52 has two side plates arranged in parallel and in the horizontal direction so that the hammer member 4 is fitted in between the two side plates. The pivoting holes 53 are formed in each of the two side plates of the each fitting portion 52. The rotate axis 41*a* of the hammer member 4 is fitted into the pivoting holes 53, and thereby the hammer member 4 is rotatably supported about the rotate axis 41*a*. The pivoting holes 53 of the plurality of fitting portions 52 have a central axis coinciding with each other, and thus the hammer holding member 5 rotatably and separately holds the plurality of hammer members 4 about the common rotate axis.

Further, the fitting portions 52 are arranged in parallel and in the horizontal direction at a predetermined distance, and thus the hammer holding member 5 is configured to hold the plurality of hammer members 4 in the horizontal direction at the predetermined distance.

The hammer unit 3 is configured to allow each hammer member 4 to swingably move up and down (or rotate) between an initial state P1 in which the key 2 is not operated and thereby the weight piece 43 is positioned at a lower limit position, and a depressed state Pu in which the key 2 is operated and thereby the weight piece 43 is positioned at an upper limit position.

When such hammer unit 3 is provided in the keyboard device 1 (electronic keyboard instrument 100), the hammer member 4 swings within a range between P1 and Pu. At least one of the upper limit stopper 61 and the lower limit stopper 62 (all not shown) restricts the hammer member 4 from swinging outside the range between P1 and Pu. Such range between P1 and Pu is referred to as a restricted range.

When such hammer unit 3 is not provided in the keyboard device 1 (electronic keyboard instrument 100), the hammer member 4 swings within a range between Pu and Pf. Such range between Pu and Pf is referred to as a swing free range. Therefore, the restricted range is narrower than the swing free range. When the hammer unit 3 is not provided in the keyboard device 1 (electronic keyboard instrument 100), at least one of the hammer members 4 can be locked at the position Pf so as not to swing. Pf is positioned outside of the restricted range between P1 and Pu. Since the hammer member 4 is locked in the position Pf, the hammer unit 3 can be easily moved, and can be suitably provided in the keyboard device 1 (electronic keyboard instrument 100).

More specifically, the hammer member 4 is configured to have a swinging range which is restricted in the keyboard device 1 by an upper limit stopper 61 and a lower limit stopper 62 provided on a chassis 6 of the keyboard device 1. That is, the hammer member 4 is restricted at the lower limit position in the initial state P1 in a manner that the weight piece 43 is in contact with the lower limit stopper 62 from above, and is restricted at the upper limit position in the depressed state Pu in a manner that the weight piece 43 is in contact with the upper limit stopper 61 from below.

Further, in an individual state in which the hammer unit 3 is not yet built in the keyboard device 1 (the electronic keyboard instrument 100), the hammer unit 3 is configured to hold each hammer member 4 in a temporal locking state Pf outside a swinging range in normal use which is from the initial state P1 to the depressed state Pu. The temporal locking state Pf is a state in which the weight piece 43 further lowers from the position in the initial state P1.

A temporal locking structure of the hammer unit 3 which holds each hammer member 4 in the temporal locking state Pf will be described below.

Figure 4A:
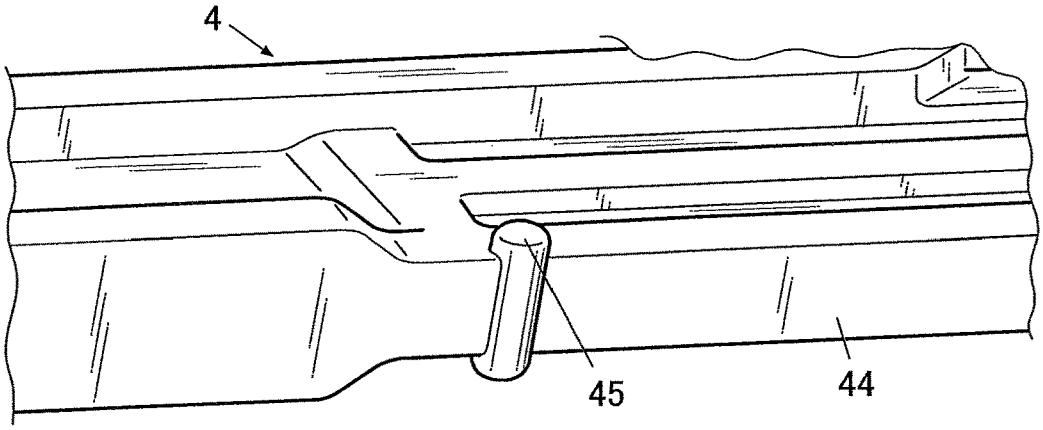
FIGS. 4A-4C are views illustrating a temporal locking structure of a hammer unit according to a first embodiment.
Figure 4B:
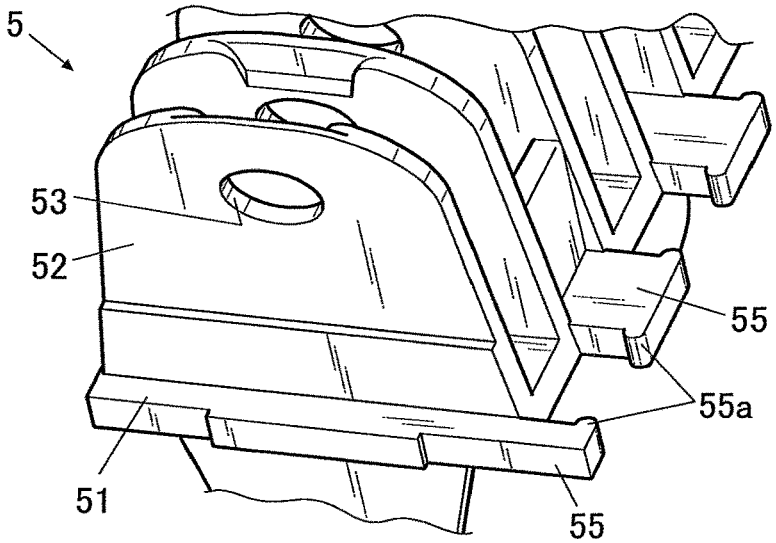
Figure 4C:
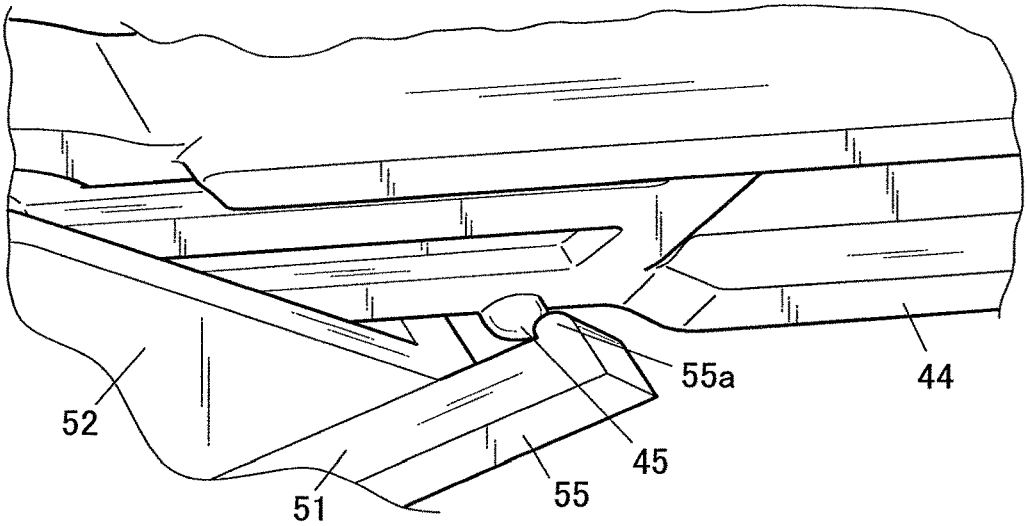

FIGS. 4A-4C are views illustrating a temporal locking structure of the hammer unit 3.

As shown in FIG. 4A, the hammer member 4 has a protrusion 45, which protrudes in the horizontal direction, at a lower portion in the middle of the first section in the hammer arm 44 which slopes downward and backward (see FIG. 3). The both sides of the protrusion 45 are formed in substantially semispherically-rounded shapes.

On the other hand, as shown in FIG. 4B, the hammer holding member 5 has a plurality of elongated portions 55 formed in a manner that portions other than the fitting portion 52 (i.e., both side portions outside the fitting portion 52) in a back portion of the base plate 51 are elongated backward. The elongated portion 55 has an engaging portion 55*a*, which protrudes in an inward direction of the fitting portion 52, at a back end on an inward-directed internal side of the fitting portion 52 in the horizontal direction. The engaging portion 55*a* is provided to come into contact with the protrusion 45 of the hammer arm 44 when the hammer member 4 is rotated about the rotate axis 41*a*, and both front and back sides thereof are rounded so that the protrusion 45 can easily climbs over the engaging portion 55*a*.

A distance between the two engaging portions 55*a* provided on the hammer holding member 5 and a distance between portions of the two protrusions 45 to be in contact with the two engaging portions 55*a* are designed to have the following relationship. That is, the distance between contact surfaces of the two engaging portions 55*a* when the engaging portions 55*a* are not deformed is designed to be narrower than the distance between contact surfaces of the two protrusions 45, whereas the distance between the contact surfaces of the two engaging portions 55*a* when the engaging portions 55*a* are elastically deformed is designed to be wider than the distance between contact surfaces of the two protrusions 45.

By this configuration, in the hammer unit 3, the protrusions 45 of the hammer arm 44 and the engaging portions of the hammer holding member 5 come into contact with each other if the hammer member 4 is rotated so as to cause the weight piece 43 to lower from the position in the initial state P1. Then, in such a situation, if the hammer member 4 is further rotated in the same direction, as shown in FIG. 4C, the protrusion 45 of the hammer arm 44 elastically deforms and climbs over the engaging portion 55*a* of the hammer holding member 5, and thus is engaged with the engaging portion 55*a*, thereby resulting in the temporal locking state Pf in which swinging of the hammer member 4 is restricted.

Further, if the hammer member 4 is rotated so as to cause the weight piece 43 to lift from the position in the temporal locking state Pf, the protrusion 45 of the hammer arm 44 elastically deforms and climbs over the engaging portion 55*a* of the hammer holding member 5, and thus the engagement by the engaging portion 55*a* is released. By this, the temporal locking in the hammer member 4 is released, thereby returning to the swingable state from the temporal locking state Pf.

Specifically, in the hammer unit 3, the hammer holding member 5 holds the plurality of hammer members 4 so that the temporal locking state PF in which each hammer member 4 is temporally locked and the state in which the temporal locking is released can be taken. Further, the hammer holding member 4 allows the hammer members 4 to alternately transition between the temporal locking state Pf and the released state.

It is noted that in engagement/disengagement of the protrusion 45 with/from the engaging portion 55*a* (elongated portion 55), the engaging portion 55*a* of the hammer holding member 5 may not be always deformed. In some examples, at least one of the protrusion 45 and the engaging portion 55*a* may be configured to be elastically deformed.

Further, even if the hammer member 4 is in the temporal locking state Pf and the hammer holding member 5 holds the hammer member 4 in any direction, the hammer holding member 5 allows the hammer member 4 to be temporally locked by a force that the temporal locking state Pf cannot be terminated by the own weight of the hammer member 4. That is, the protrusion 45 of the hammer member 5 and the engaging portion 55*a* of the hammer holding member 5 can be engaged and disengaged with each other, and also they can be engaged with each other by an adequate force so as not to be easily released from the engaged state by the own weight of the hammer member 4 even if the hammer member 4 is engaged in any direction.

An example of an assembly process to attach the hammer unit 3 to the keyboard device 1 (electronic keyboard instrument 100) will be described below.

Figure 5A:
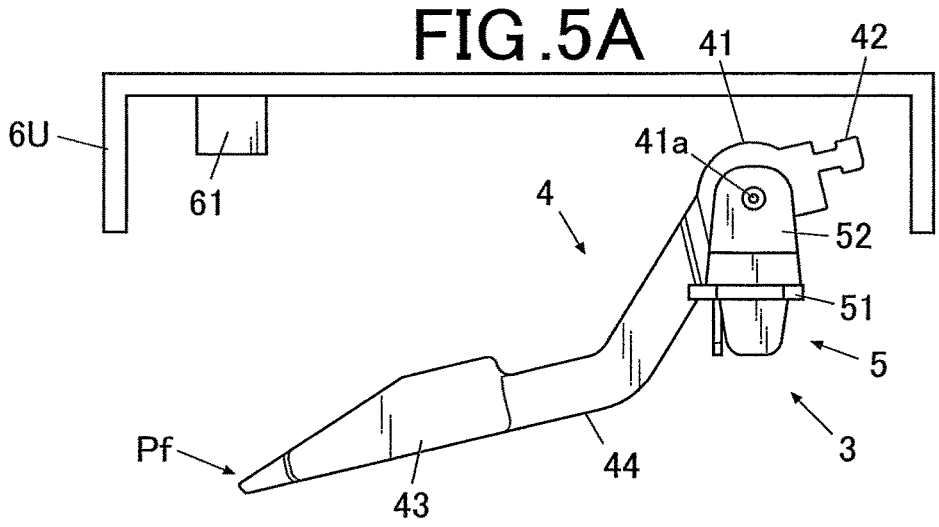
FIGS. 5A-5C are views illustrating an assembly process of attaching a hammer unit to a keyboard instrument.
Figure 5B:
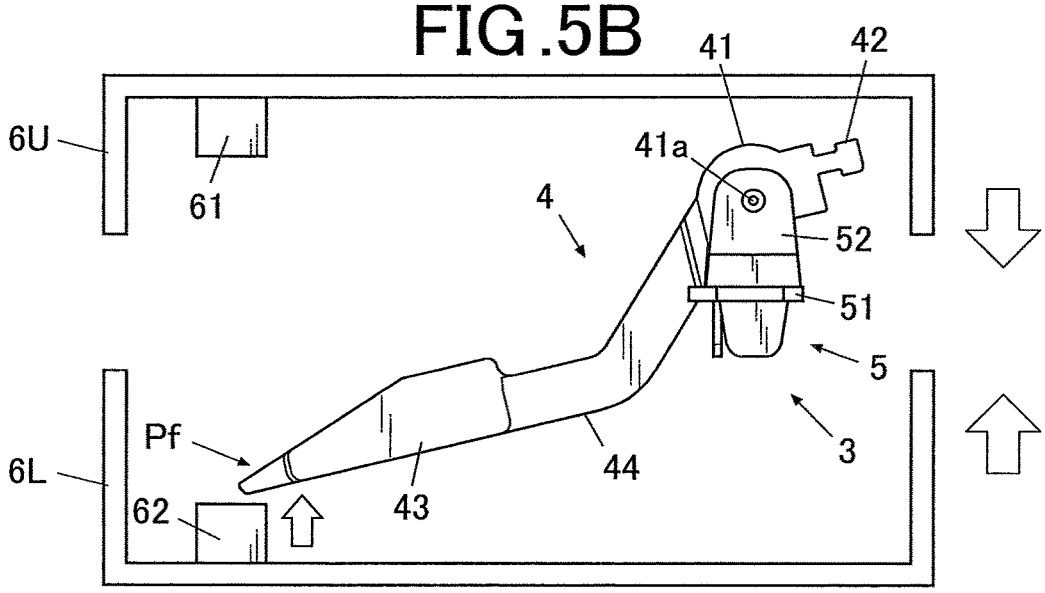
Figure 5C:
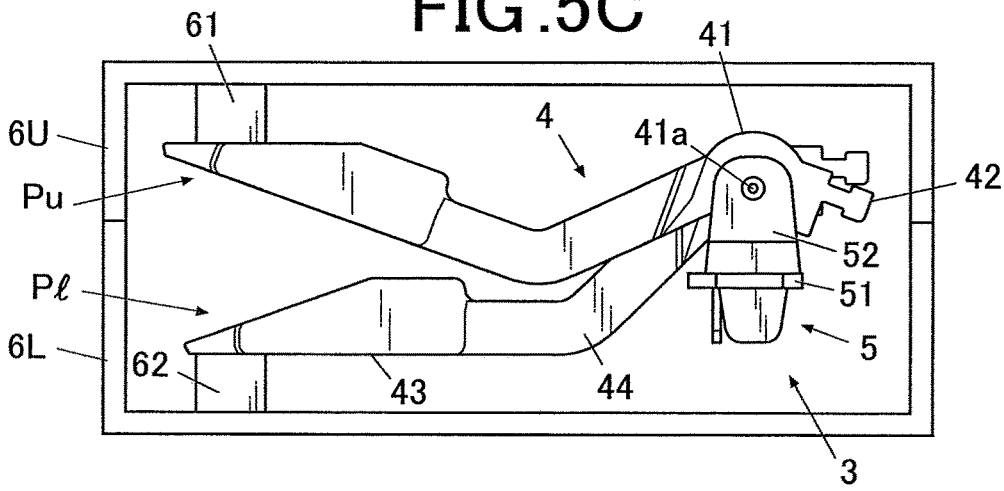

FIGS. 5A-5C are views illustrating such an assembly process.

For simplicity of explanation, the chassis 6 of the keyboard device 1 is configured by an upper chassis 6U and a lower chassis 6L having the upper limit stopper 6*a* and the lower limit stopper 62, respectively. Thus, in FIGS. 5A-5C, the upper chassis 6U and the lower chassis 6L are shown as simplified shapes.

As shown in FIG. 5A, first, the hammer unit 3 is attached to the upper chassis 6U having the upper limit stopper 61 in a situation in which each hammer member 4 is held in the temporal locking state.

In this situation, as each hammer member 4 is temporally locked not to freely and disorderly swing, the hammer unit 3 can easily be attached to the upper chassis 6U.

Next, as shown FIG. 5B, the lower chassis 6L having the lower limit stopper 62 is attached to the upper chassis 6U from below.

At this time, by way of pushing the weight piece 43 of the hammer member 4 upward by the lower limit stopper 62, each hammer member 4 rotates so as to cause the weight piece 43 to lift and the temporal locking state Pf is released, and as a result, the plurality of hammer members 4 are held by the hammer holding member 5 separately swingable within a restricted range between P1 and Pu. That is, the range that the hammer member 4 is able to move is enlarged from the temporal locking state Pf to the restricted range between P1 and Pu.

Then, by way of locking the upper chassis 6U and the lower chassis 6L, as shown in FIG. 5C, the hammer unit is attached to the chassis 6 of the keyboard in a situation in which the hammer member 4 swingably rotates between the initial state P1 and the depressed state Pu. In this situation, as a lower limit position of the hammer member 4 is restricted by the lower limit stopper 62, the temporal locking state Pf can be avoided.

As described above, according to the present embodiment, the hammer holding member 5 is configured to hold the hammer member so that the hammer member 4 can be taken between the temporal locking state Pf and the state in which the temporal locking is released. By this, in attaching the hammer unit 3 to the chassis 6, the hammer member does not freely and disorderly swing.

Accordingly, working efficiency in attaching the hammer member 4 to the chassis 6 can be enhanced.

Further, as the hammer member 4 in the temporal locking state Pf is at a position outside the swinging range in normal use, the hammer member 4 is not temporally locked at this position in normal use.

Further, as the protrusion 45 of the hammer member 4 is configured to engage and disengage with the engaging portion 55*a* of the hammer holding member 5 in a manner of elastically deforming and climbing over the engaging portion 55*a* of the hammer holding member 5 in association with the rotation of the hammer member 4, the temporal locking and the releasing can easily be achieved simply by rotating the hammer member 4.

Further, as the hammer holding member 4 is configured to separately hold the plurality of hammer members 4, the hammer unit 3 into which the plurality of hammer members 4 are put together can be attached to the chassis 6, thereby further enhancing the working efficiency in assembling.

Further, the hammer holding member 5 allows the hammer member 4 to alternately transition between the temporal locking state Pf and the released state. That is, in a case where the hammer unit 3 is restored to a disassembled state from the state in which the hammer unit 3 is built in the keyboard device 1, the hammer member 4 can be placed again in the temporal locking state Pf. Thus, in a process of disassembling and thereafter reassembling of the keyboard device 1 (electronic keyboard instrument 100), by way of temporally locking the hammer member 4, the work efficiency can be enhanced.

Further, at the time when the hammer unit 3 is attached to the lower chassis 6L having the lower limit stopper 62, the hammer member 4 is depressed by the lower limit stopper 62 and thereby the temporal locking state Pf is released.

By this, the releasing process only for releasing the temporal locking state Pf of the hammer member 4 is unnecessary, and thus the working efficiency in assembling can be further enhanced.

It is noted that any member or element having the lower limit stopper 62 in the keyboard device 1 can be used for releasing the temporal locking state Pf in conjunction with attaching the hammer member 4, regardless of the chassis 6 (the lower chassis 6L).

In addition, the lower limit stopper 62 for releasing the temporal locking state Pf may be replaced with another member or element in the keyboard device (the electronic keyboard instrument 100).

Second Embodiment

Referring now to FIG. 6, a hammer unit and a keyboard device having the same of a second embodiment according to the present invention will be described below.

The second embodiment is different from the first embodiment in a temporal locking structure of the hammer unit, and accordingly the following descriptions may focus on different points from the first embodiment.

Figure 6A:
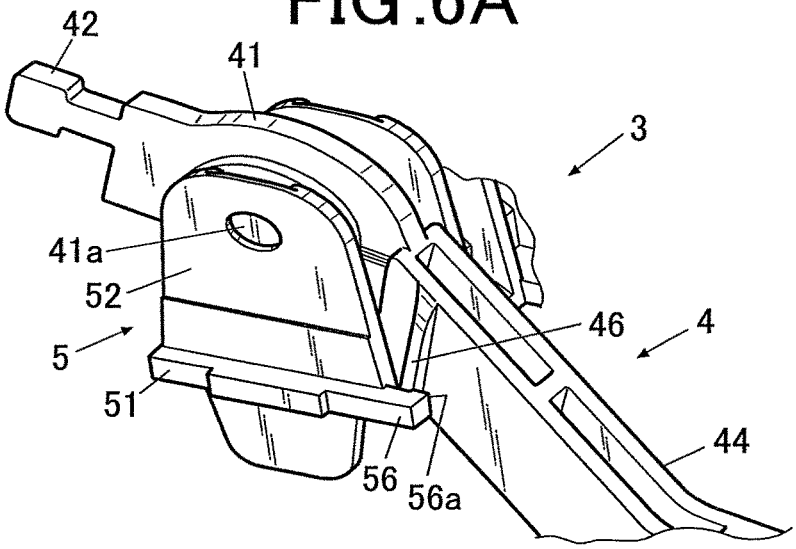
FIGS. 6A-6C are views illustrating a temporal locking structure of a hammer unit according to a second embodiment.
Figure 6B:
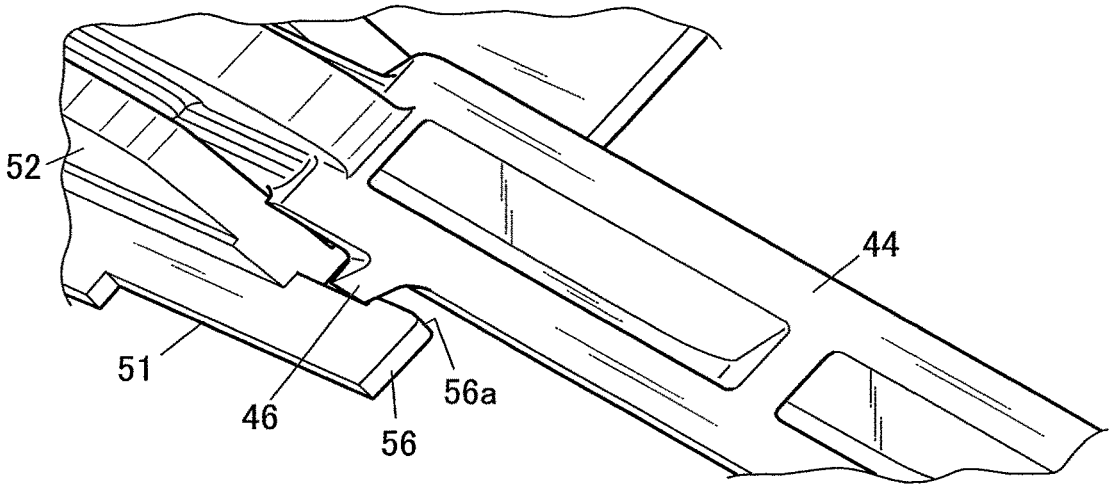
Figure 6C:
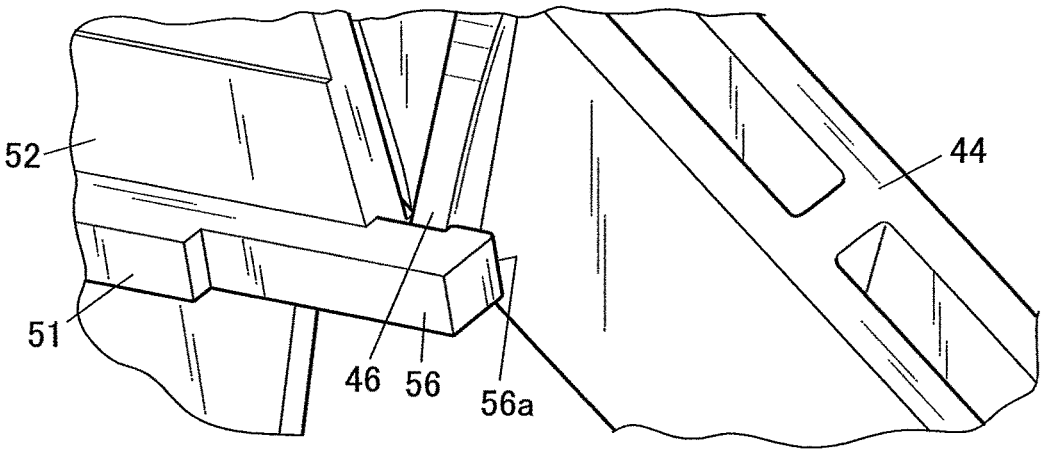

FIGS. 6A-6C are views illustrating a temporal locking structure of a hammer unit according to the present embodiment.

As shown in FIGS. 6A-6C, in the hammer unit 3 of the present embodiment, the hammer member 4 has a rib 46, instead of the protrusion 45 of the first embodiment, and the hammer holding member 5 has an elongated portion 56, instead of the elongated portion 55 of the first embodiment.

The rib 46 of the hammer member 4 is provided at a base portion, in a vicinity of the axis supporting piece 41, in one side of the hammer arm 44 to form a precipitous slope uplifting backward.

On the other hand, the elongated portion 56 of the hammer holding member 5 is configured so that a portion on one side in a back end portion of the base plate 51 extends further backward than the fitting portion 52. The elongated portion 56 has an engaging portion 56*a* in an inward direction of the fitting portion 52, at a back end on an inward-directed internal side of the fitting portion 52 in the horizontal direction. The engaging portion 55*a* is provided to come into contact with the rib 46 of the hammer arm 44 when the hammer member 4 is rotated about the rotate axis 41*a*, and both front and back sides thereof are rounded so that the rib 46 can easily climb over the engaging portion 56*a*.

By way of the configuration, the hammer unit 3 of the present embodiment can operably function, like that of the first embodiment.

Specifically, in the hammer unit 3 of the present invention, when the hammer member 4 rotates to cause the weight piece 43 to lower from the position in the initial state P1, the rib 46 of the hammer arm 44 and the engaging portion 56*a* of the hammer holding member 5 come into contact with each other. Then, in such a situation, if the hammer member 4 is further rotated in the same direction, the rib 46 of the hammer arm 44 climbs over the engaging portion 56*a* of the hammer holding member 5, and thus is engaged with the engaging portion 56*a*, thereby resulting in the temporal locking state Pf in which swinging of the hammer member 4 is restricted.

Further, if the hammer member 4 is rotated so as to cause the weight piece 43 to lift from the position in the temporal locking state Pf, the rib 46 of the hammer arm 44 climbs over the engaging portion 56*a* of the hammer holding member 5, and thus the engagement by the engaging portion 56*a* is released, thereby returning to the swingable state from the temporal locking state Pf.

Accordingly, according to the above second embodiment, the advantages described above same as those of the first embodiment can be achieved.

Third Embodiment

Referring next to FIGS. 7A-7D, a hammer unit and a keyboard device having the same of a third embodiment according to the present invention will be described below.

The third embodiment is different from the first embodiment in a temporal locking structure of the hammer unit, and accordingly the following descriptions may focus on different points from, among other, the first embodiment.

Figure 7A:
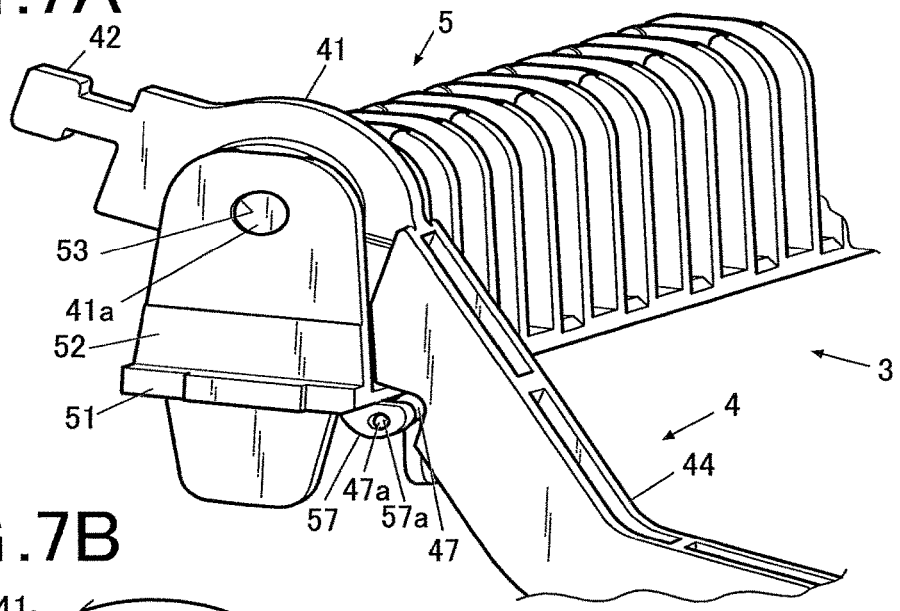
FIGS. 7A-7D are views illustrating a temporal locking structure of a hammer unit according to a third embodiment.
Figure 7B:
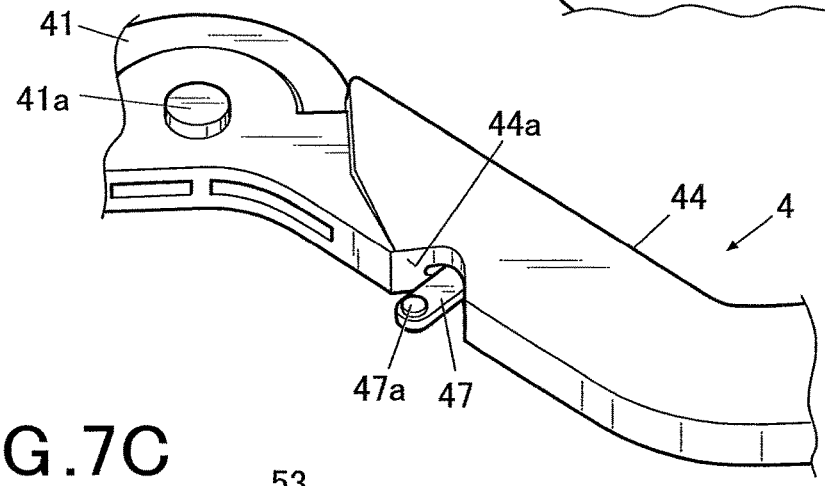
Figure 7C:
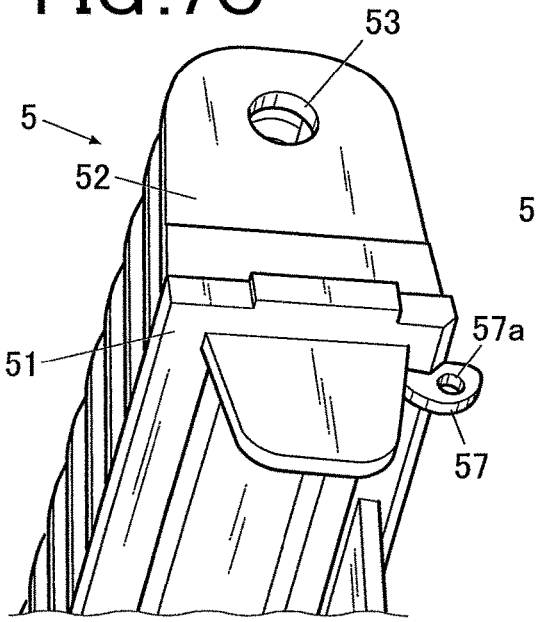

FIGS. 7A-7C are views illustrating a temporal locking structure of a hammer unit 3 according to the present embodiment.

As shown in FIG. 7A, in the hammer unit 3 of the present embodiment, the hammer member 4 has a projection 47, instead of the protrusion 45 of the first embodiment, and the hammer holding member 5 has an engaging rib 57, instead of the elongated portion 55 of the first embodiment.

The projection 47 of the hammer member 4 projects from a notch 44*a* in a substantially L-shape formed at a lower portion of the base portion, in a vicinity of the axis supporting piece 41, in the hammer arm 44 so as to be directed downward in the forward direction in the temporal locking state Pf. At a tip portion (distal end) of one surface of the projection 47, a circular bulging portion 47*a* which moderately bulges is provided.

Figure 7D:
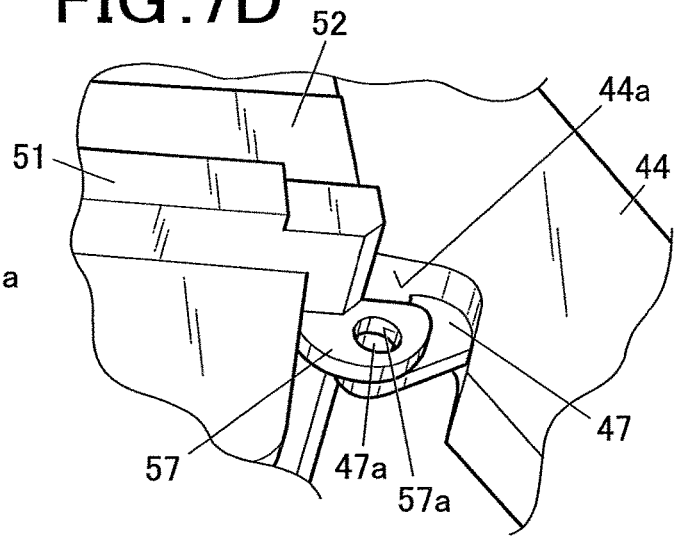

On the other hand, the engaging rib 57 of the hammer holding member 5 is provided, as shown in FIG. 7C, at the back end portion on a lower surface of the base plate 51 to protrude slightly backward. The engaging rib 57 is positioned to be adjacent to the projection 47 of the hammer arm 44 in the horizontal direction when the hammer member rotates about the rotate axis 41*a*. Further, the engaging rib 57 has an engaging hole 57*a* which conforms with a profile of the bulging portion 47*a* of the hammer arm 44. As shown in FIG. 7D, the engaging hole 57*a* is provided to receive the bulging portion 47*a* of the hammer arm 44 when the hammer member 4 rotates about the rotate axis 41*a*.

By way of the configuration, the hammer unit 3 of the present embodiment can operably function, like that of the first embodiment.

Specifically, in the hammer unit 3 of the present invention, when the hammer member 4 rotates to cause the weight piece 43 to lower from the position in the initial state P1, the bulging portion 47*a* of the hammer arm 44 and the back end surface of the engaging rib 57 of the hammer holding member 5 come into contact with each other. Then, in such a situation, if the hammer member 4 is further rotated in the same direction, the bulging portion 47*a* of the hammer arm 44 fits into and then engage with the engaging hole 57*a* of the hammer holding member 5, thereby resulting in the temporal locking state Pf in which swinging of the hammer member 4 is restricted.

Further, if the hammer member 4 is rotated so as to cause the weight piece 43 to lift from the position in the temporal locking state Pf, the bulging portion 47*a* of the hammer arm 44 comes off from the engaging hole 57*a* of the hammer holding member 5, and thus the engagement by the engaging hole 57*a* is released, thereby returning to the swingable state from the temporal locking state Pf.

Accordingly, according to the above third embodiment, the advantages described above same as those of the first embodiment can be achieved.

Fourth Embodiment

Figure 8A:
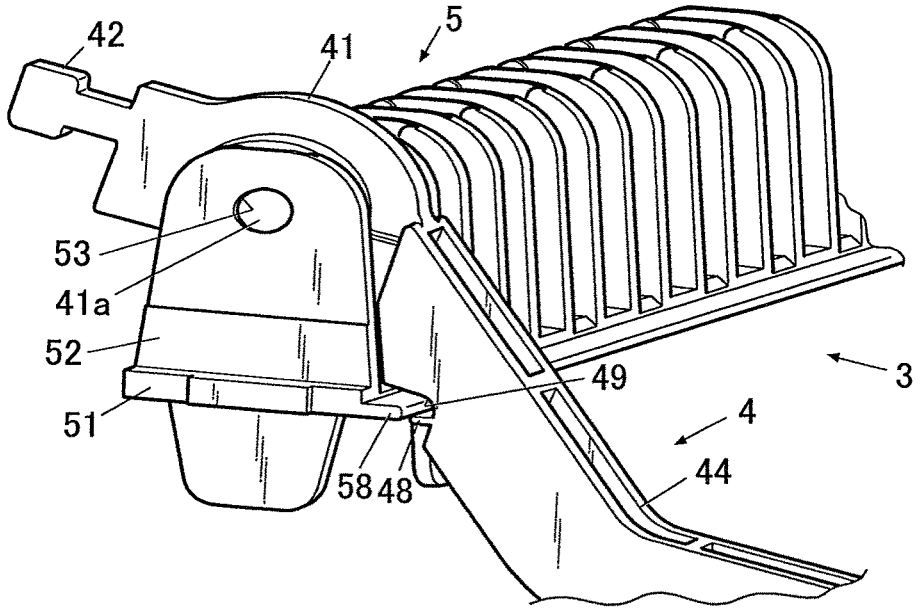
FIGS. 8A-8C are views illustrating a temporal locking structure of a hammer unit according to a fourth embodiment.
Figure 8B:
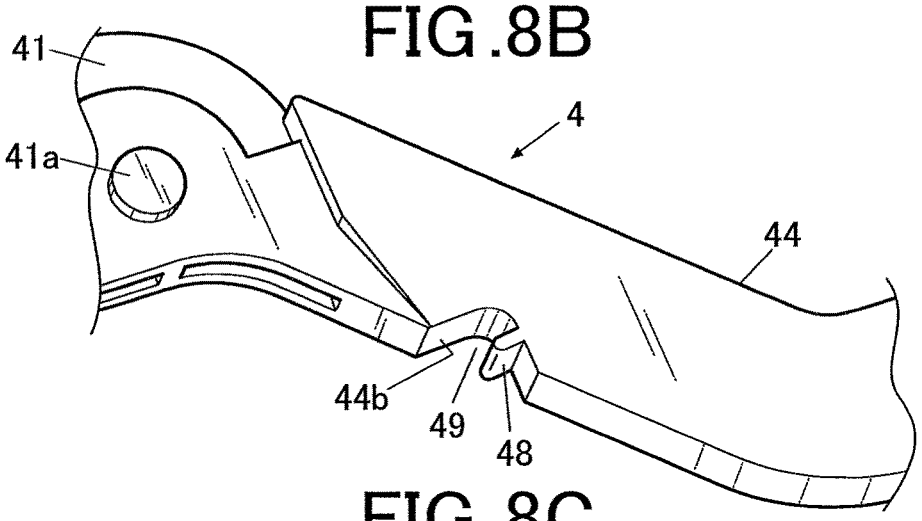
Figure 8C:
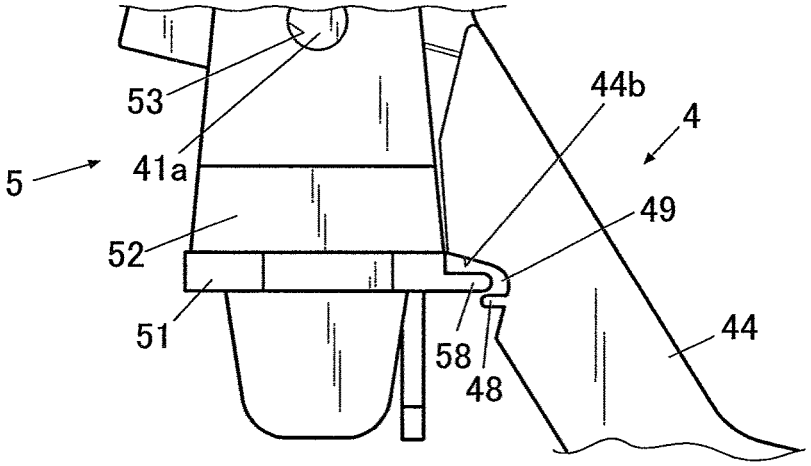

Referring now to FIGS. 8A-8C, a hammer unit and a keyboard device having the same of a fourth embodiment according to the present invention will be described below.

The fourth embodiment is different from the first embodiment in a temporal locking structure of the hammer unit, and accordingly the following descriptions may focus on different points from the first embodiment.

FIGS. 8A-8C are views illustrating a temporal locking structure of a hammer unit according to the present embodiment.

As shown in FIG. 8A, in the hammer unit 3 of the present embodiment, the hammer member 4 has a tongue 48, instead of the protrusion 45 of the first embodiment, and the hammer holding member 5 has an engaging plate 58, instead of the elongated portion 55 of the first embodiment.

As shown in FIG. 8*b*, the tongue 48 of the hammer member 4 projects from a notch 44*b* in a substantially L-shape formed at a lower portion of the base portion, in a vicinity of the axis supporting piece 41, in the hammer arm 44 so as to be directed in the forward direction in the temporal locking state Pf. The tongue 48 is positioned at a slightly-lower side than upper edges of the notch 44*b* in the temporal locking state Pf, thereby defining a recess 49 between the tongue 48 and the upper edges of the notch 44*b*.

On the other hand, as shown in FIG. 8C, the engaging plate 58 of the hammer holding member 5 protrudes backward from the back end surface of the base plate 51 so that the back end port ion of the base plate 51 extends backward. The engaging plate 58 is provided so that each other's tip portions of the engaging plate 58 and the tongue 48 of the hammer arm 44 come into contact when the hammer member rotates about the rotate axis 41*a*.

By way of the configuration, the hammer unit 3 of the present embodiment can operably function, like that of the first embodiment.

Specifically, in the hammer unit 3 of the present invention, when the hammer member 4 rotates to cause the weight piece 43 to lower from the position in the initial state P1, each other's tip portions of the tongue 4 of the hammer arm 44 and the engaging plate 58 of the hammer member 4 come into contact. Then, in such a situation, if the hammer member 4 is further rotated in the same direction, the tongue 48 of the hammer arm 44 climbs over the engaging plate 58 of the hammer holding member 5 and then is engaged within the recess 49, thereby resulting in the temporal locking state Pf in which swinging of the hammer member 4 is restricted.

Further, if the hammer member 4 is rotated so as to cause the weight piece 43 to lift from the position in the temporal locking state Pf, the tongue 48 of the hammer arm 44 climbs over the engaging plate 58 of the hammer holding member 5, and thus the engagement by the engaging plate 58 is released, thereby returning to the swingable state from the temporal locking state Pf.

Accordingly, according to the above fourth embodiment, the advantages described above same as those of the first embodiment can be achieved.

The temporal locking structure of the hammer unit is not limited to those of the first to fourth embodiments as described above. Any member or element may be used, as long as each other's engagement portions of the hammer member 4 and the hammer holding member 5 are configured to be engaged and disengaged in association with the rotation of the hammer member 4.

Further, the hammer holding member 5 may be configured to swingably hold the hammer member 5, within a range between two positions which exclude, at least, a position for temporally locking the hammer member 4 (one position being in the initial state P1 and the other position being in the depressed state Pu of the above-described embodiments), in the state in which the hammer member 4 is released from the temporal locking. In addition, a position where the hammer holding member 4 temporally locks the hammer member 4 may not have to be a position outside the swinging range in normal use of the hammer member 4.

Further, for convenience sake, in this disclosure, the examples that the key being depressed directly pushes the corresponding hammer member 4 were explained; however, the present invention can be applied to an example that a key being depressed indirectly pushes the hammer member via a transmission member such as a wippen or the like (e.g., an example is that a transmission member operates in accordance with a keying operation, instead of directly pushing the hammer member).

Specific embodiments of the present invention were described above, but the present invention is not limited to the above embodiments, and modifications, improvements, and the like within the scope of the aims of the present invention are included in the present invention. It will be apparent to those skilled in the art that various modifications and variations can be made in the present invention without departing from the spirit or scope of the invention. Thus, it is intended that the present invention covers modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A keyboard instrument comprising:

a plurality of keys;

a hammer unit including a plurality of hammer members each of which is configured to apply a load to a respective one of the plurality of keys, and a holding member to which each of the plurality of hammer members is swingably connected; and a housing comprising an upper limit stopper and a lower limit stopper, the upper limit stopper and the lower limit stopper preventing at least one of the plurality of hammer members from swinging outside a restricted range when the at least one of the plurality of hammer members swings in response to an operation by a user of its respective key, and the restricted range of the at least one of the plurality of hammer members being narrower than a swing free range of the at least one of the plurality of hammer members, wherein, when the hammer unit is not provided in the housing, the holding member temporally locks the at least one of the plurality of hammer members at a first position located outside the restricted range, and wherein, when the hammer unit is provided in the housing such that the temporal locking of the at least one of the plurality of hammer members is released by pressing the at least one of the plurality of hammer members to at least one of the upper limit stopper and the lower limit stopper, a range of motion of the at least one of the plurality of hammer members is restricted to the restricted range.

2. The keyboard instrument according to claim 1, wherein when the hammer unit is built in the housing, a state in which the plurality of hammer members are locked in the first position is released by pressing the plurality of hammer members against the at least one of the upper limit stopper and the lower limit stopper.

3. A hammer unit comprising:

a plurality of hammer members configured to apply loads to a plurality of keys respectively, the plurality of keys being mounted on a keyboard instrument;

a holding member configured to hold the plurality of hammer members in both a first holding state in which the plurality of hammer members are temporally locked at a first position and a second holding state in which the plurality of hammer members are released from being temporally locked at the first position; and a plurality of engaging portions, each engaging portion being shared by the holding portion and a respective one of the plurality of hammer members, and each engaging portion engaging the holding portion with its respective hammer member when the respective hammer member is in the first position, wherein each engaging portion comprises a protruding portion and a receiving portion, the protruding portion being provided to one of the holding portion and its respective hammer member, and the receiving portion being provided to the other one of the holding portion and its respective hammer member, and wherein each engaging portion is configured such that the protruding portion and the receiving portion thereof engage and disengage with each other by one of the protruding portion and the receiving portion elastically deforming to climb over the other of the protruding portion and the receiving portion in response to a swinging motion of its respective hammer.

4. The hammer unit according to claim 3, wherein the holding member holds the plurality of hammer members at a predefined distance apart from each other.

5. The hammer unit according to claim 3, wherein when the plurality of hammer members are in the second holding state, the holding member swingably and separately holds the plurality of hammer members.

6. The hammer unit according to claim 3, wherein when the plurality of hammer members are in the second holding state, the holding member swingably holds the plurality of hammer members within a range between a second position and a third position, the range excluding the first position.

7. The hammer unit according to claim 3, wherein the holding member is configured to hold the plurality of hammer members such that the plurality of hammer members can alternately transition between the first holding state and the second holding state.

8. The hammer unit according to claim 3, wherein the first position is a position outside a swinging range of the plurality of hammer members in normal use where the hammer unit has been built in the keyboard instrument.

9. The hammer unit according to claim 3, wherein the holding member has an axis about which each of the plurality of hammer members swingably rotates.

10. The hammer unit according to claim 3, wherein while the plurality of hammer members are in the first holding state, the holding member temporally holds the plurality of hammer members by a force that the first holding state is not released due to an own weight of the hammer member even if the hammer member is held in any direction.

* * * * *